United States Patent [19]

Kanazaki

[11] Patent Number: 5,046,441

[45] Date of Patent: Sep. 10, 1991

[54] RUDDER MECHANISM FOR SHIP

[76] Inventor: Kihachiro Kanazaki, 168-2 Oaza Usuki, Usuki, Ohita, Japan

[21] Appl. No.: 480,639

[22] Filed: Feb. 15, 1990

[30] Foreign Application Priority Data

Mar. 2, 1989 [JP] Japan ..... 1-51197

[51] Int. Cl.[5] ..... B63H 25/06

[52] U.S. Cl. ..... 114/165; 114/162

[58] Field of Search ..... 114/144 R, 150, 162, 114/168, 127, 132, 135–137

[56] References Cited

U.S. PATENT DOCUMENTS

| | | | |
|---|---|---|---|
| 1,107,408 | 8/1914 | Caille | 114/165 |
| 2,522,653 | 9/1950 | von Suttka | 114/165 |
| 2,631,559 | 3/1953 | Jones | 114/165 |
| 2,992,623 | 7/1961 | Heckel, Jr. | 114/165 |
| 3,199,485 | 8/1965 | Snider | 114/165 |
| 3,352,272 | 11/1967 | Brazier | 114/165 |
| 3,941,072 | 3/1976 | Caton | 114/165 |
| 4,008,677 | 2/1977 | Wordell, Sr. | 114/165 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

A rudder mechanism for a ship comprises a support bearing fixed to the bottom of a stern of the ship, a rudder shaft with one end rotatably supported by the support bearing, a swayable shaft member connected to the other end of the rudder shaft, and a rudder wing connected to the swayable shaft member and disposed behind a propeller of the ship. The swayable shaft member and rudder wing form a swayable wing portion swayable in a ship backward direction. The swayable shaft member comprises a projection fixed to the rudder shaft or the rudder wing, a projection receiver fixed to the other of them and engaged with the projection, and a rotatable shaft inserted into the engaged projection and projection receiver to enable them to sway relative to each other. The projection and projection receiver have restriction faces for restricting the swayable wing portion from swaying in a ship forward direction beyond a vertical position and from swaying in a ship backward direction beyond a maximum backward position.

With this arrangement, the rudder wing will not be just behind the propeller of the ship while the ship is sailing, thereby improving the propelling efficiency and fuel consumption of the ship.

8 Claims, 6 Drawing Sheets

RUDDER MECHANISM FOR SHIP

BACKGROUND OF THE INVENTION

1. Field of the Invention

The present invention relates to a rudder mechanism disposed at the stern of a ship and capable of reducing resistance against ship propelling water flows.

2. Description of the Prior Art

FIG. 9 shows a conventional rudder mechanism disposed at the stern of a ship. The rudder mechanism is positioned behind a propeller P and has a rudder shaft S vertically and rotatably supported at the stern. A rudder wing W is fixed to an end of the rudder shaft S and rotatable together with the rudder shaft S. The rudder shaft S is tuned manually or by motor to provide a required rudder angle.

The conventional rudder mechanism is not flexible, however, and fixedly positioned with the rudder shaft S behind the propeller P, so that, as shown in FIG. 10, the rudder mechanism may partly block water flows propelled backward by the propeller P. Particularly when the ship sails across the ocean at a full speed with no rapid steering operation, the rudder mechanism resisting the propelling water flows may increasingly deteriorate the propelling efficiency and fuel consumption of the ship.

SUMMARY OF THE INVENTION

To solve the above problem, an object of the present invention is to provide a swayable rudder mechanism for a ship, having a rudder shaft, a swayable shaft member connected to the rudder shaft, and a rudder wing connected to the swayable shaft member, the swayable shaft member and rudder wing forming a swayable rudder portion that will be swayed in the ship backward direction, so that the rudder wing will not be behind a propeller of the ship while the ship is sailing, thereby improving the propelling efficiency and fuel consumption of the ship.

In order to accomplish the object, the present invention provides a rudder mechanism for a ship, comprising a support bearing fixed to a lower part of a stern of the ship; a rudder shaft of which one end is rotatably supported by the support bearing; a swayable shaft member connected to the other end of the rudder shaft; and a rudder wing connected to the swayable shaft member and disposed behind a propeller of the ship. The swayable shaft member and rudder wing form a swayable wing portion that is swayable in a ship backward direction.

According to an aspect of the invention, the swayable shaft member comprises a projection fixed to and protruding from one of the other end of the rudder shaft and the rudder wing; a projection receiver fixed to the other of the other end of the rudder shaft and the rudder wing and engaged with the projection; and a rotatable shaft inserted into the engaged projection and projection receiver such that the engaged projection and projection receiver can sway relative to each other. The projection and projection receiver have restriction faces for securely restricting the swayable wing portion from swaying in a ship forward direction beyond a vertical position and from swaying in a ship backward direction beyond a maximum backward position.

The projection is preferably a tonguelike plate having an arc edge, while the projection receiver is preferable to have a groove for receiving the tonguelike plate. The groove has an arc guide corresponding to the arc edge of the projection. The restriction faces include a first restriction face extending from the arc edge of the tonguelike plate; a second restriction face extending from the base of the tonguelike plate and substantially orthogonal to an axial line of the rudder shaft with the swayable rudder portion being in the vertical position; a third restriction face extending from the arc guide of the projection receiver; and a fourth restriction face which is an end face of the projection receiver. The first restriction face cooperates with the third restriction face while the second restriction face cooperates with the fourth restriction face, thereby restricting the swayable wing portion from swaying in the ship forward direction beyond the vertical position.

The swayable shaft member may comprise a disk-like projection fixed to and protruding from the other end of the rudder shaft; a projection receiver fixed to the rudder wing and engaged with the disk-like projection; and a rotatable shaft inserted into the engaged disk-like projection and projection receiver such that the engaged disk-like projection and projection receiver can sway relative to each other. The projection receiver may have a groove for receiving the disk-like projection. The disk-like projection may have a radially protruding portion provided with a restriction face cooperating with the base of the projection receiver to restrict the swayable wing portion from swaying in the ship forward direction beyond the vertical position.

The base of the disk-like projection preferably has a V-shape side. This V-shape side involves a first end face oriented downward and cooperating with an end face of the projection receiver to restrict the swayable wing portion from swaying in the ship forward direction beyond the vertical position; and a second end face oriented downward and cooperating with the end face of the projection receiver to restrict the swayable wing portion from swaying in a ship backward direction beyond a maximum backward position.

The rudder wing preferably comprises a rectangular plate-like body. A rectangular part of the rudder wing defined by a long side and about one half to one third of a short side of the rectangular plate-like body is in the ship forward side relative to an axial line of the rudder shaft with the swayable wing portion being in the vertical position.

According to the above rudder mechanism of the invention, the swayable rudder portion is substantially in the vertical position when the ship is stationary. When the ship is driven forward, a propeller of the ship generates backward water flows, which gradually make the swayable rudder portion sway backward around the swayable shaft member. When the ship reaches to a full speed, only a part of the swayable rudder portion is in the water and still enables a steering operation of the ship.

BRIEF DESCRIPTION OF THE DRAWINGS

FIG. 5(*b*) is a perspective view showing a projection;

FIG. 15(*b*) is a perspective view showing a projection receiver of the swayable shaft member;

DETAILED DESCRIPTION OF THE EMBODIMENTS

A rudder mechanism for a ship according to an embodiment of the invention will be explained with reference to FIGS. 1 to 8.

Figure 1:
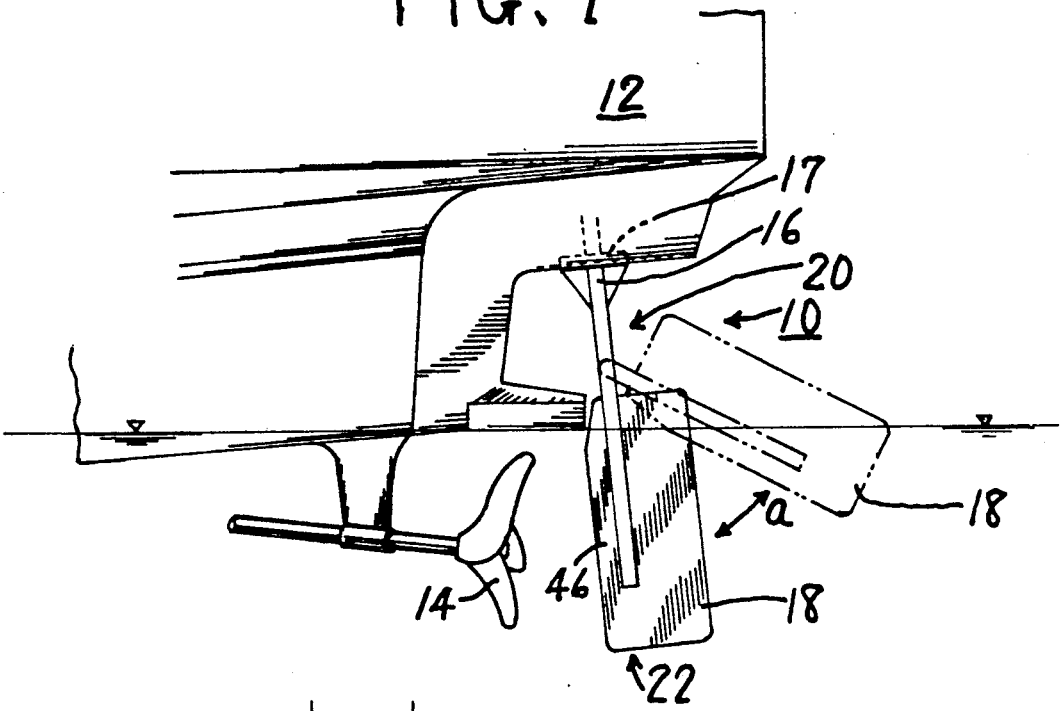
FIG. 1 is a perspective view showing the stern of a ship employing a rudder mechanism according to an embodiment of the present invention.

FIG. 1 is a perspective view showing a rudder mechanism 10 of the embodiment. The rudder mechanism 10 is disposed under the bottom of a stern 12 behind a propeller 14 of a ship. The rudder mechanism 10 includes a rudder shaft 16, one end of which is rotatably supported by a support bearing 17 shown in dotted line, which is fitted to the bottom of the stern 12. The rudder mechanism 10 further includes a rudder wing 18 fixed to the other end of the rudder shaft 16 through a swayable shaft member 20.

This swayable shaft member 20 forms a feature of the invention. The swayable shaft member 20 and the rudder wing 18 form a swayable wing portion 22.

Figure 2:
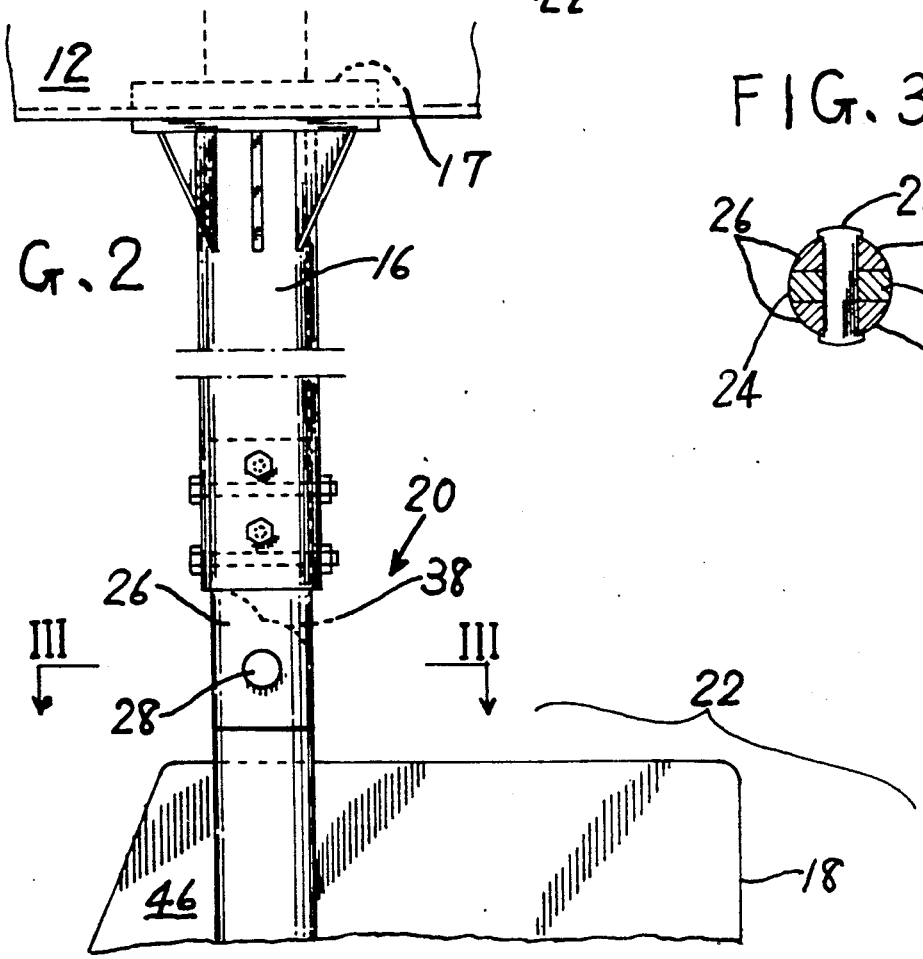
FIG. 2 is a view showing the essential part of a swayable shaft member.
Figure 3:
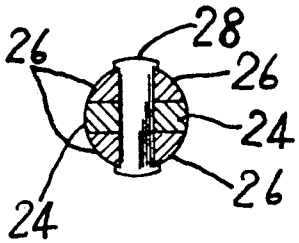
FIG. 3 is a sectional view taken along a line III—III of FIG. 2.
Figure 4:
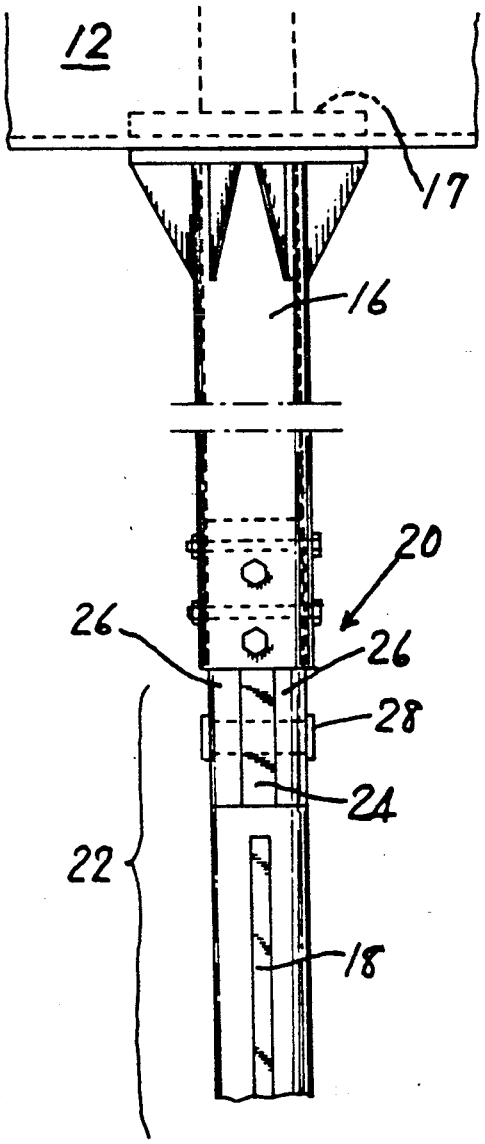
FIG. 4 is a right side view of FIG. 2.

In FIGS. 2, 3 and 4, the rudder shaft 16 is a cylindrical pipe supported rotatably by the support bearing 17 fixed to the bottom of the stern 12 of the ship. The rudder shaft 16 is connected to the rudder wing 18 through the swayable shaft member 20.

Figure 5A:
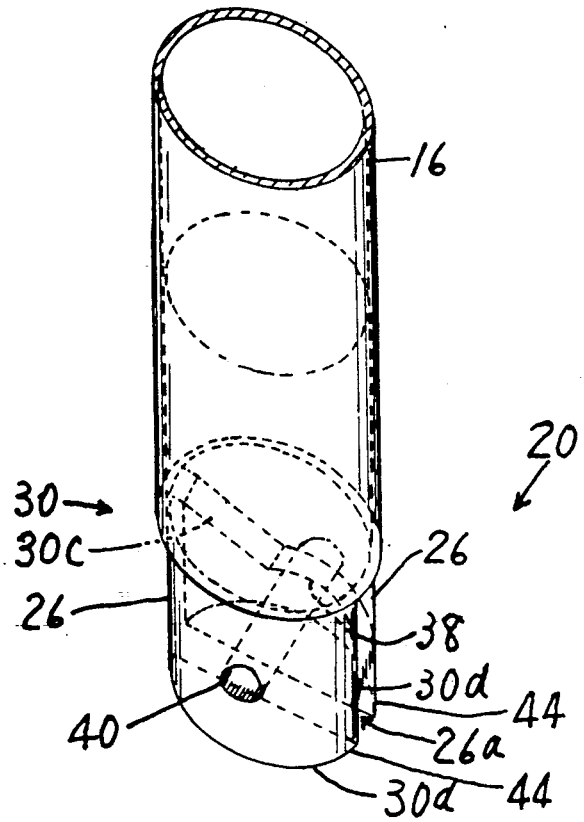
FIG. 5(*a*) is a perspective view showing a projection receiver.
Figure 5B:
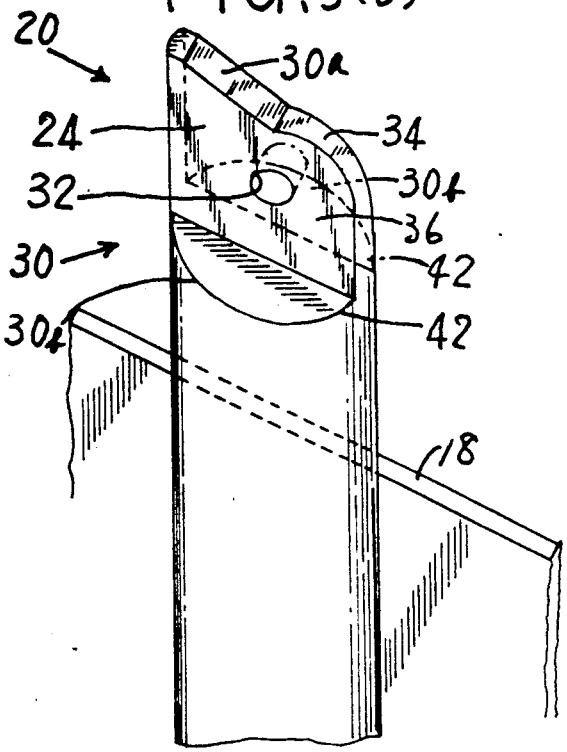

As shown in FIG. 5(*a*) and 5(*b*), the swayable shaft member 20 comprises a projection 24, a projection receiver 26, and a rotatable shaft 28. The projection 24 is attached to and protrudes from the rudder wing 18. The projection receiver 26 is fixed to the rudder shaft 16 and holds the projection 24 from both sides thereof. The rotatable shaft 28 is inserted into the engaged projection 24 and projection receiver 26 such that the projection 24 and projection receiver 26 can sway relative to each other.

The projection 24 and projection receiver 26 have restriction faces 30 that restrict the swayable wing portion 22 from swaying in a ship forward direction beyond a vertical position and from swaying in a ship backward direction beyond a maximum backward position.

When the ship moves forward, the propeller 14 generates backward water flows, by which the swayable wing portion 22 is gradually swayed backward around the swayable shaft member 20. When the ship moves forward at a full speed, the swayable wing portion 22 is swayed to the maximum backward position. Consequently, no obstacle may exist just behind the propeller 14 to block the ship propelling water flows, thus improving the propelling efficiency and fuel consumption of the ship.

The swayable wing portion 22 is restricted from swaying in the ship forward direction beyond the vertical position. Namely, the swayable wing portion 22 is prevented from turning in the ship forward direction beyond a position where the swayable wing portion 22 linearly aligns with the rudder shaft 16. Also, the swayable wing portion 22 is restricted from swaying in the ship backward direction beyond the maximum backward position.

The projection 24 is a tonguelike plate 36 having a center shaft hole 32 and an arc edge 34.

The projection receiver 26 is fixed by bolts to the lower end of the rudder shaft 16 which is a cylindrical pipe. The projection receiver 26 holds the projection 24 from both sides thereof. The projection receiver 26 has a groove 26*a* forming an arc guide 38 that corresponds to the arc edge 34 of the projection 24.

As explained above, the projection 24 and projection receiver 26 have the restriction faces 30 for restricting the swayable wing portion 22 from swaying in the ship forward direction beyond the vertical position and from swaying in the ship backward direction beyond the maximum backward position. The restriction faces 30 comprise a first, second, third and fourth restriction faces 30*a*, 30*b*, 30*c* and 30*d*.

The first restriction face 30*a* is formed on the arc edge 34 of the tonguelike plate 36 and rises obliquely upward as shown in FIG. 5(*b*).

The second restriction face 30*b* extends from the base of the tonguelike plate 36 and is substantially orthogonal to an axis of the rudder shaft 16 with the swayable wing portion 22 being in the vertical position. The second restriction face 30*b* is formed on each side of the tonguelike plate 36.

The third restriction face 30*c* extends from the arc guide 38 of the projection receiver 26, and rises obliquely upward as shown in FIG. 5(*a*) to correspond to the first restriction face 30*a*. The third restriction face 30*c* cooperates with the first restriction face 30*a* to restrict the swayable wing portion 22 from swaying in the ship forward direction (clockwise direction) beyond the vertical position.

The fourth restriction face 30*d* is an end face of each side portion of the projection receiver 26 for holding the projection 24. The fourth restriction face 30*d* cooperates with the second restriction face 30*b* to restrict the swayable wing portion 22 from swaying in the ship forward direction (clockwise direction) beyond the vertical position.

Each side of the projection receiver 26 has a shaft hole 40, and as shown in FIGS. 2 and 4, the rotatable shaft 28 is inserted into the shaft holes 40 of the projection receiver 26 and the shaft hole 32 of the engaging projection 24, thereby rotatably supporting the projection 24 and projection receiver 26.

The swayable wing portion 22 is restricted from turning in the ship backward direction (counterclockwise direction) beyond the maximum backward position by an edge 42 of the second restriction face 30*b* and an edge 44 of the fourth restriction face 30*d*.

The swayable shaft member 20 is preferably located close to and higher than the bottom of the ship, so that, when the ship moves forward, the swayable wing portion 22 may sway in the ship backward direction with only a part of the rudder wing 18 sinking in the water and the main part of the rudder wing 18 not existing just behind the propeller 14.

As shown in FIG. 2, the rudder wing 18 is a rectangular metal plate. With the rudder wing 18 being in the vertical position, a forward section 46 of the rudder wing 18 is in the ship forward side relative to an axial line of the rudder shaft 16. The forward section 46 may be defined by a long side and about a third of a short side of the rudder wing 18. The length of the short side of the forward section 46 may be set to occupy at most a half of the short side of the rudder wing 18, depending on a draft of the ship or a fitting position of the swayable shaft member 20. When the ship moves forward, particularly at a full speed, the forward section 46 sinks in the water as shown in FIG. 1 but enables a steering operation of the ship.

When the ship is not moving, the swayable wing portion 22 takes the vertical position indicated with a continuous line in FIG. 1. If the propeller 14 is driven to move the ship forward, water flows pushed by the propeller 14 gradually turn the swayable wing portion 22 in the direction of an arrow mark "a" (the ship backward direction) in FIG. 1. When the ship reaches to a full speed, the swayable wing portion 22 may take the maximum backward position indicated with a dotted line in FIG. 1, where only the forward section 46 of the rudder wing 18 is under the water to enable a steering operation of the ship.

Figure 6:
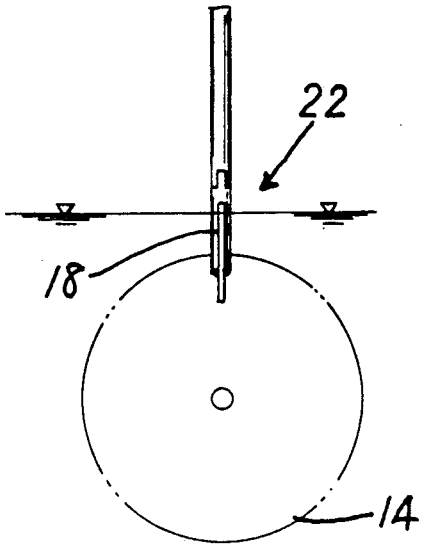
FIG. 6 is a back view showing an operation of the rudder mechanism.
Figure 9:
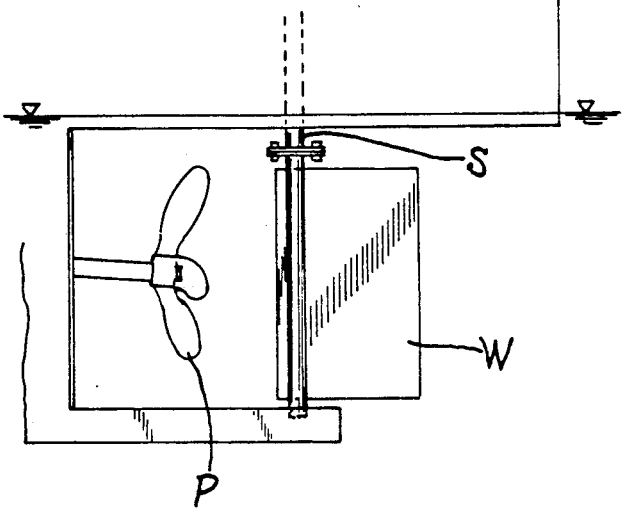
FIG. 9 is a view showing a conventional rudder mechanism.
Figure 10:
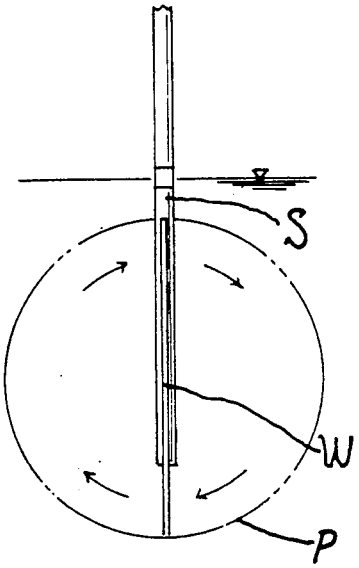
FIG. 10 is a back view showing an operation of the conventional rudder mechanism.

As shown in FIG. 6, there is no obstacle just behind the propeller 14 to block water flows, when the ship moves forward. Accordingly, a propelling force of the propeller 14 is fully utilized to move the ship, thereby saving fuel consumption. Since the resistance against the propelling force by the rudder wing 18 is reduced, the propeller 14 strongly pushes water downward to push the ship upward. With the synergetic effects, the speed and fuel consumption of the ship are improved greatly.

According to an experiment, the rudder mechanism of the invention can reduce the fuel consumption by 20% to 30%, compared to the conventional rudder mechanism. In addition, the propelling efficiency of the ship is improved to increase the speed of the ship about two times the one achieved by the conventional rudder mechanism. At a full-speed forward movement, the ship travels as if it slides over the water. Particularly in the ocean where a gentle steering operation is sufficient at the full speed movement, the backward swaying effect of the swayable wing portion 22 is remarkable.

When the ship arrives at a port, the propeller 14 is slowed to reduce the speed of the ship. Then, water flows generated by the propeller 14 are weakened, so that the weight of the rudder wing 18 brings the swayable wing portion 22 into the water. Finally, the swayable wing portion 22 takes the vertical position indicated with the continuous line in FIG. 1. This enables a rapid steering operation for a backward movement or slow forward movement of the ship.

At this time, the swayable wing portion 22 is restricted from swaying in the ship forward direction beyond the vertical position by the cooperating first and third restriction faces 30*a* and 30*c* and by the cooperating second and fourth restriction faces 30*b* and 30*d*.

When the ship advances at a full speed with no rapid steering operation, the swayable wing portion 22 partly sinks in the water and is not just behind the propeller 14. For a backward movement or slow speed forward movement of the ship, the swayable wing portion 22 is automatically brought just behind the propeller 14 to enable a sufficient steering operation of the ship.

The projection 24 may be attached to the rudder shaft 16 and the projection receiver 26 to the rudder wing 18.

Figure 7:
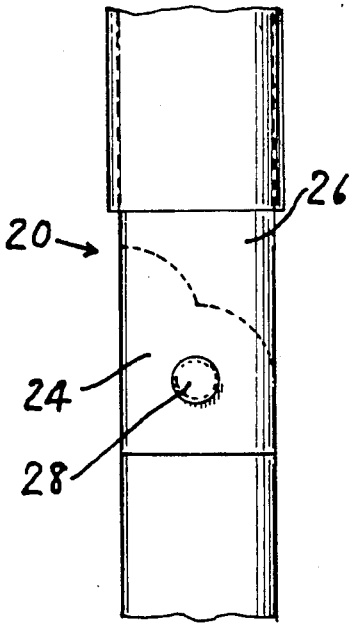
FIGS. 7 and 8 are front and right side views, respectively, showing a modification of the embodiment with first and second arcing restriction faces.
Figure 8:
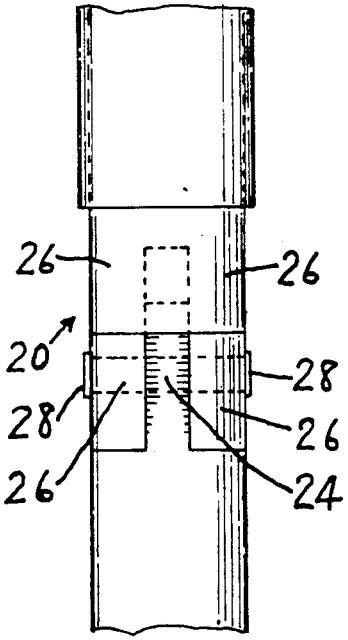

Only the first and third restriction faces 30*a* and 30*c* are sufficient if they can surely restrict the swayable wing portion 22 from swaying in the ship forward direction beyond the vertical position. It is also possible to form arc faces on the first and third restriction faces 30*a* and 30*c* as shown in FIGS. 7 and 8.

FIGS. 11 to 17 are views showing a swayable shaft member of a rudder mechanism for a ship, according to another embodiment of the invention. In the figures, like parts are represented with like reference marks, and their explanations are omitted.

Similar to the previous embodiment, a swayable shaft member 20 comprises a projection 24, a projection receiver 26 engaging with the projection 24, and a rotatable shfat 28 inserted into the engaged projection 24 and projection receiver 26 such that the projection 24 and projection receiver 26 are swayable relative to each other. The projection 24 is attached to and protrudes from a rudder shaft 16, while the projection receiver 26 is attached to a rudder wing 18, which forms, with the swayable shaft member 20, a swayable wing portion 22. The projection receiver 26 has a groove 48 into which the projection 24 is inserted and held.

As shown in the figures, the projection 24 comprises a disk 50, a sectorial part of which is fixed to the center of the rudder shaft 16. The disk 50 has a radial projection 52 having a restriction face 30*e*. The restriction face 30*e* extends along an axis of the rudder shaft 16 and is oriented in the ship backward direction. The restriction face 30*e* abuts against a base 54 of the projection receiver 26, thereby restricting the swayable wing portion 22 from swaying in the ship forward direction beyond a vertical position.

The projection receiver 26 may be attached to the rudder shaft 16, and the projection 24 to the rudder wing 18. Due to resistance against water flows and the weight of the disk 50, however, it is reasonable to attach the projection 24 to the rudder shaft 16 and the projection receiver 26 to the rudder wing 18, as explained above.

Figure 11:
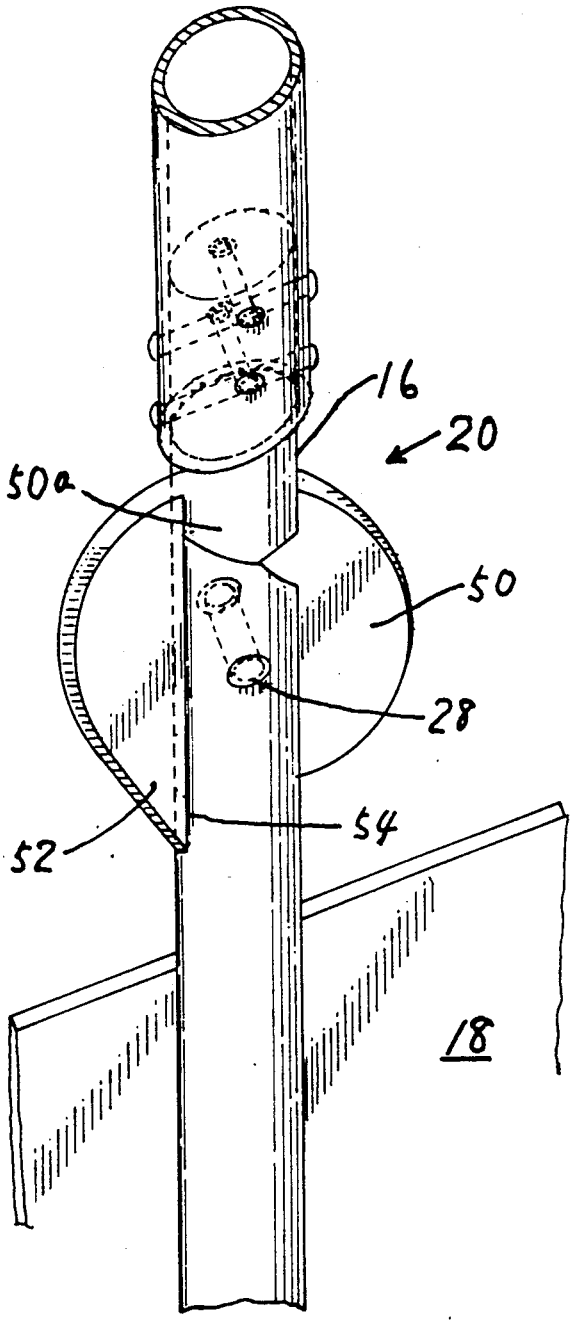
FIG. 11 is a perspective view showing the essential part of a swayable shaft member according to another embodiment of the invention.
Figure 12:
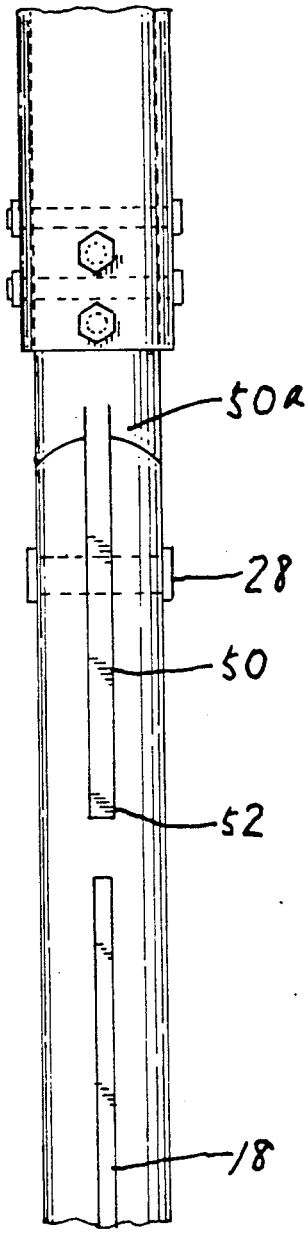
FIG. 12 is a front view showing the swayable shaft member.
Figures 13, 14:
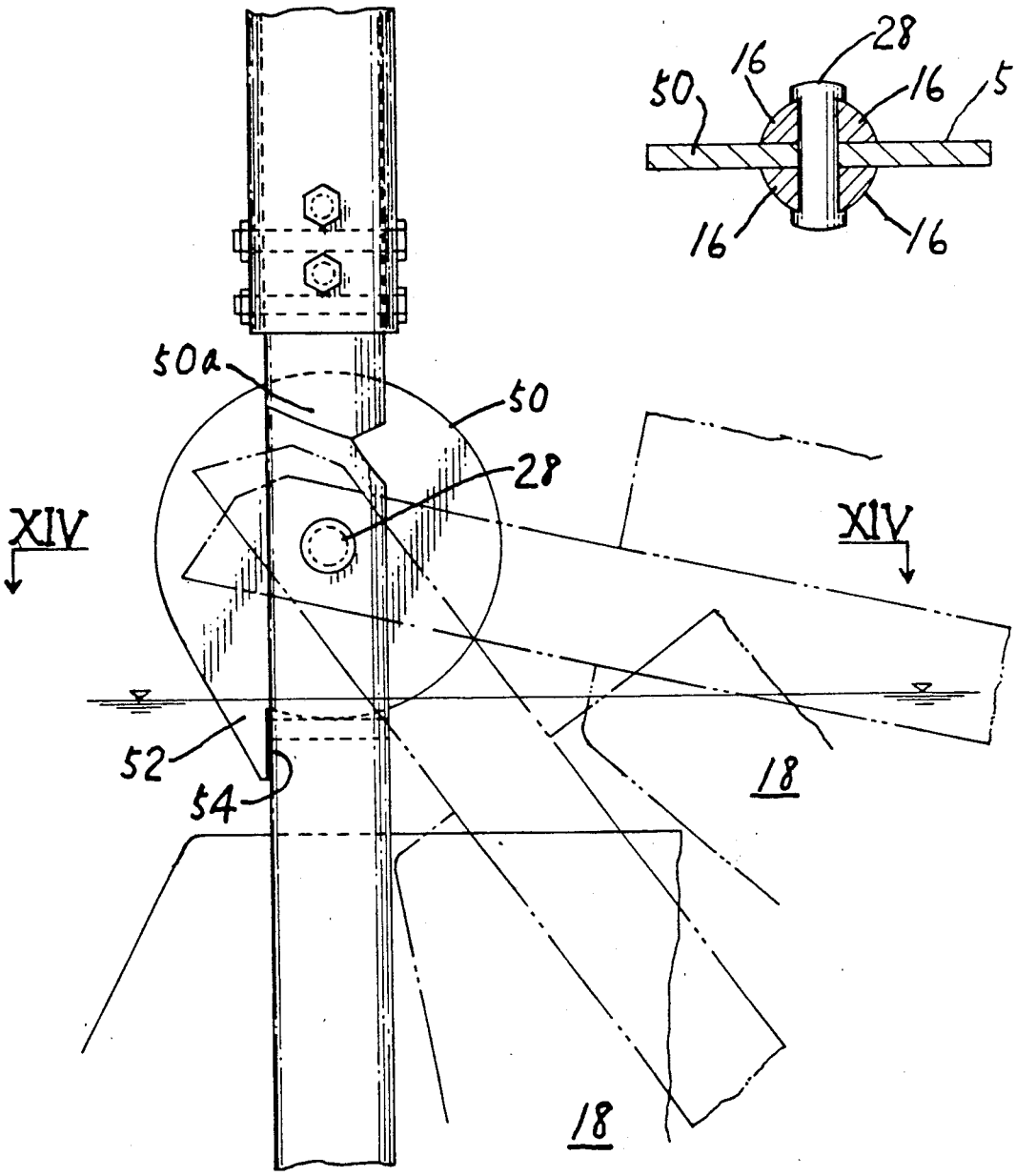
FIG. 13 is a side view showing an operation of the swayable shaft member.
FIG. 14 is a sectional view taken along a line XIV—XIV of FIG. 13.
Figure 16:
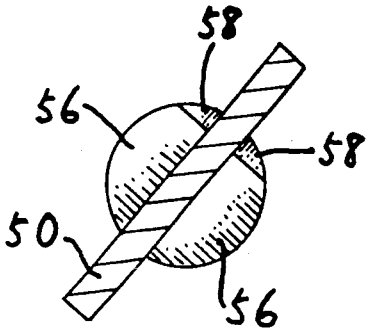
FIG. 16 is a sectional view taken along a line XVI—XVI of FIG. 15(*a*)
Figure 15A:
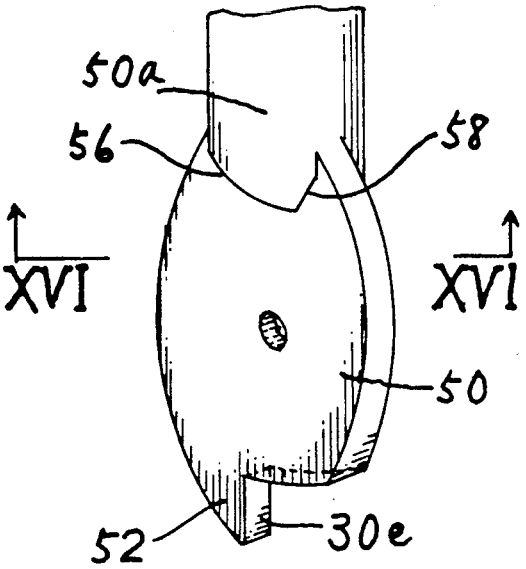
FIG. 15(*a*) is a perspective view showing a projection of the swayable shaft member.
Figure 17:
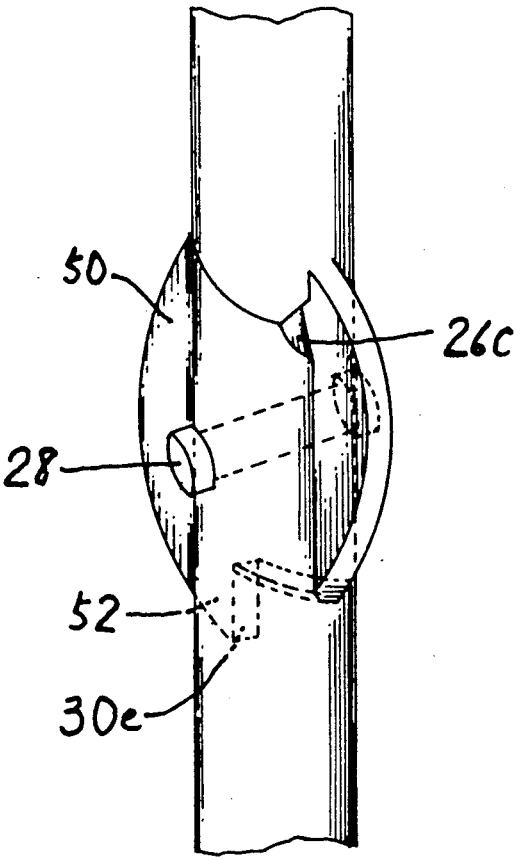
FIG. 17 is a perspective view showing the essential part of the swayable shaft member seen from a different angle.
Figure 15B:
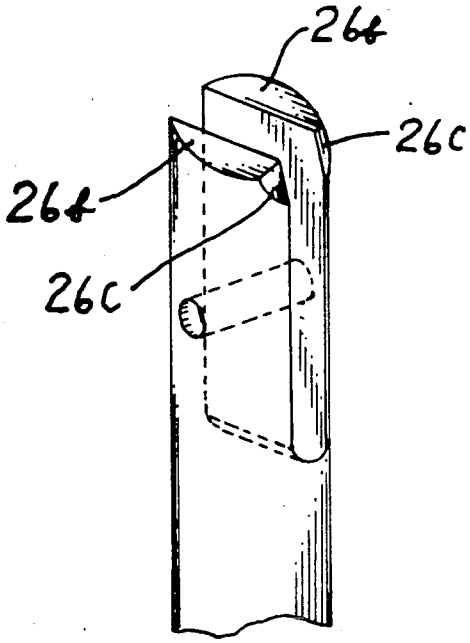

As shown in FIGS. 11, 13 and 16, a base 50*a* of the disk 50 has a V-shape side face having a first end face 56 and a second end face 58. The first end face 56 is oriented downward and cooperates with an end face 26*b* of the projection receiver 26 to restrict, similar to the restriction face 30*e*, the swayable wing poriton 22 from swaying in the ship forward direction beyond the vertical position. The second end face 58 cooperates with an end face 26*c* of the projection receiver 26 to restrict the swayable wing portion 22 from swaying in the ship backward direction (counterclockwise direction) beyond a maximum backward position.

As explained above, the swayable wing portion 22 is restricted from swaying in the ship forward direction beyond the vertical position by the restriction face 30*e* of the radial projection 52 cooperating with the base 54 of the projection receiver 26 and by the first end face 56 of the base 50*a* of the disk 50 cooperating with the end face 26*b* of the projection receiver 26. Further, the swayable wing portion 22 is restricted from swaying in the ship backward direction beyond the maximum backward position by the end face 26*c* of the projection receiver 26 cooperating with the second end face 58 of the base 50*a* of the disk 50.

In this embodiment, actions of the swayable shaft member 20 in the forward and backward movements of the ship are the same as those of the previous embodiment. In this embodiment, however, the projection 24 and projection receiver 26 are easier to manufacture, compared to those of the previous embodiments. In addition, the swayable wing portion 22 of this embodiment is more securely restricted from swaying in the ship backward direction.

The rudder mechanism of the present invention is applicable not only for small ships but also for large ships, if the swayable shaft member of the rudder mechanism is made harder.

As explained above, according to a rudder mechanism for a ship of the invention, a swayable shaft member is attached to a rudder shaft and to a rudder wing of the rudder mechanism to form a swayable wing portion that can sway in a ship backward direction. Accordingly, the rudder wing will not be just behind a propeller of the ship while the ship is sailing, thereby improving the propelling efficiency and fuel consumption of the ship.

What is claimed is:

1. A rudder mechanism for a ship, comprising:

a support bearing fixed to a lower part of a stern of the ship;

a rudder shaft of which one end is rotatably supported by said support bearing;

a free rotation means connected to the other end of said rudder shaft;

a swayable shaft member connected to said free rotation means; and a rudder wing connected to said swayable shaft member and disposed behind a propeller of the ship, said swayable shaft member and rudder wing forming a swayable wing portion that is swayable in a direction away from the stern of the ship through said free rotation means.

2. A rudder mechanism for a ship according to claim 1, wherein said swayable shaft member comprises:

a projection fixed to and protruding from one of the other end of said rudder shaft and said rudder wing;

a projection receiver fixed to the other of the other end of said rudder shaft and said rudder wing, and engaged with the projection; and said free rotation means comprising a rotatable shaft inserted into the engaged projection and projection receiver, such that the engaged projection and projection receiver can away relative to each other.

3. A rudder mechanism for a ship according to claim 2, wherein said projection and projection receiver have restriction faces for restricting the swayable wing portion from swaying in a ship forward direction beyond a vertical position and from swaying in a ship backward direction beyond a maximum backward position.

4. A rudder mechanism for a ship according to claim 3, wherein the projection is a tonguelike plate having an arc edge, while the projection receiver has a groove for receiving the tonguelike plate, the groove having an arc guide corresponding to the arc edge of the projection, and wherein the restriction faces include:

a first restriction face extending from the arc edge of the tonguelike plate;

a second restriction face extending from the base of the tonguelike plate and substantially orthogonal to an axial line of said rudder shaft with the swayable rudder portion being in the vertical position;

a third restriction face extending from the arc guide of the projection receiver; and a fourth restriction face which is an end face of the projection receiver, the first restriction face cooperating with the third restriction face while the second restriction face cooperating with the fourth restriction face, thereby restricting the swayable wing portion from swaying in the ship forward direction beyond the vertical position.

5. A rudder mechanism for a ship according to claim 1, wherein said swayable shaft member comprises:

a disk-like projection fixed to and protruding from the other end of said rudder shaft;

a projection receiver fixed to said rudder wing and engaged with the disk-like projection; and a rotatable shaft inserted into the engaged disk-like projection and projection receiver such that the engaged disk-like projection and projection receiver can sway relative to each other, the projection receiver having a groove for receiving the disk-like projection, the disk-like projection having a radially protruding portion provided with a restriction face cooperating with the base of the projection receiver to restrict the swayable wing portion from swaying in a ship forward direction beyond a vertical position.

6. A rudder mechanism for a ship according to claim 5, wherein the base of the disk-like projection has a V-shape side, the V-shape side having:

a first end face oriented downward and cooperating with an end face of the projection receiver to restrict the swayable wing portion from swaying in the ship forward direction beyond the vertical position; and a second end face oriented downward and cooperating with the end face of the projection receiver to restrict the swayable wing portion from swaying in a ship backward direction beyond a maximum backward position.

7. A rudder mechanism, for a ship, comprising:

a support bearing fixed to a lower part of a stern of the ship;

a rudder shaft of which one end is rotatably supported by said support bearing;

a swayable shaft member connected to other end of said rudder shaft;

a rudder wing connected to said swayable shaft member and disposed behind a propeller of the ship; and a swayable wing portion swayable in a ship backward direction comprising said swayable shaft member, said rudder wing, a projection fixed to and protruding from one of the other end of said rudder shaft and said rudder wing, a projection receiver fixed to the other of the other end of said rudder shaft and said rudder wing and engaged with the projection, and a rotatable shaft inserted into the engaged projection and projection receiver such that the engaged projection and projection receiver can sway relative to each other, the projection and projection receiver having restriction faces for restricting the swayable wing portion from swaying in a direction away from the stern of the ship beyond a maximum backward position.

8. A rudder mechanism for a ship according to any one of claims 1–7, wherein said rudder wing comprises a rectangular plate-like body, a rectangular part of said rudder wing defined by a long side and about one half to one third of a short side of the rectangular plate-like body being in the ship forward side relative to an axial line of said rudder shaft with the swayable wing portion being in the vertical position.

* * * * *